US006027844A

United States Patent [19]

Nguyen et al.

[11] Patent Number: 6,027,844

[45] Date of Patent: Feb. 22, 2000

[54] POLYMERIC BINDERS HAVING SATURATED RING FOR IMPROVED PERFORMANCE OF SINGLE LAYER POSITIVE ORGANIC PHOTOCONDUCTOR

[75] Inventors: Khe C. Nguyen, Los Altos; Sivapackia Ganapathiappan, Fremont, both of Calif.

[73] Assignee: Hewlett-Packard Company, Palo Alto, Calif.

[21] Appl. No.: 08/506,283

[22] Filed: Jul. 24, 1995

Related U.S. Application Data

[63] Continuation-in-part of application No. 08/218,205, Mar. 25, 1994, abandoned.

[51] Int. Cl.[7] ..... G03G 5/06; G03G 5/05

[52] U.S. Cl. ..... 430/56; 430/96; 430/130; 430/134

[58] Field of Search ..... 430/96, 130, 134, 430/78, 56

[56] References Cited

U.S. PATENT DOCUMENTS

| | | | |
|---|---|---|---|
| 4,559,287 | 12/1985 | McAneney et al. | 430/59 |
| 4,734,348 | 3/1988 | Suzuki et al. | 430/96 |
| 4,891,288 | 1/1990 | Fujimaki et al. | 430/58 |
| 5,087,540 | 2/1992 | Murakami et al. | 430/58 |
| 5,252,415 | 10/1993 | Yoshizawa et al. | 430/56 |
| 5,320,923 | 6/1994 | Nguyen | 430/78 |
| 5,324,615 | 6/1994 | Stegbauer et al. | 430/132 |

OTHER PUBLICATIONS

Butvar—Properties and Uses. Monsanto Chemical Company, St. Louis, MO. pp. 3–4, 1991.

Borsenberger, Paul M. & David S. Weiss. Organic Photoreceptors for Imaging Systems. New York: Marcel–Dekker, Inc. pp. 28–31, 1993.

*Primary Examiner*—Christopher D. Rodee

[57] ABSTRACT

Composites comprising polymeric binders and phthalocyanine pigments to form a single layer positive organic photoconductor are provided for use in electrophotography. The polymeric binders comprise an aliphatic polymer or copolymer having a saturated ring for each repeat unit either included in the polymer chain or pendant therefrom and about 4 to 35% of functional groups such as —OH, —SH, —N<, >NH, and —$NH_2$ per repeat unit. The saturated ring portion, being essentially non-polar, or at least less polar than an unsaturated ring, maintains the specific morphology of the phthalo-cyanine pigments commonly employed in positive charge organic photoconductors (OPCs) and results in a stable dispersion required for the stable performance of the OPC. Keeping the functional groups listed above to less than about 35% ensures that the photoresponse is not reduced to an unacceptable level. Heating of the composite is used to control the concentration of the functional groups. One or more separate thermal carrier generation control agents comprising compounds containing the functional group(s) may be used to provide part or all of the functional groups in the composite. The resulting composite evidences thermal stability of electronic properties, such as dark decay, at elevated temperatures in the range of about 35° to 75° C.

23 Claims, No Drawings

POLYMERIC BINDERS HAVING SATURATED RING FOR IMPROVED PERFORMANCE OF SINGLE LAYER POSITIVE ORGANIC PHOTOCONDUCTOR

CROSS REFERENCE TO RELATED APPLICATION

The present application is a continuation-in-part application of application Ser. No. 08/218,205, filed Mar. 25, 1994, now abandoned.

TECHNICAL FIELD

The present invention relates generally to image transfer technology and, more specifically, to electrophotography, employing a positive charging, organic photoconductor material including polymeric binders.

BACKGROUND ART

Electrophotographic laser printing employs a toner containing pigment components and thermoplastic components for transferring a latent image formed on selected areas of the surface of an insulating, photoconducting material to an image receiver, such as plain paper, coated paper, transparent substrate (conducting or insulative), or an intermediate transfer medium.

There is a demand in the laser printer industry for multicolored images. Responding to this demand, designers have turned to liquid toners, with pigment components and thermoplastic components dispersed in a liquid carrier medium, usually special hydrocarbon liquids. With liquid toners, it has been discovered that the basic printing color (yellow, magenta, cyan, and black) may be applied sequentially to a photoconductor surface, and from there to a sheet of paper or intermediate medium to produce a multi-colored image.

Specific morphologies of phthalocyanine (Pc) pigment powder have been known to exhibit excellent photoconductivity. These phthalocyanine pigments have been used as a mixture in polymeric binder matrices in electrophotographic photoconductors, deposited on a conductive substrate. In these phthalocyanine/binder photoconductors, the photogeneration of charge and the charge transport occur in the particles of the phthalocyanine pigment, while the binder is inert. Therefore, the photoconductor may be made of a single layer of phthalocyanine/binder. These single-layer photoconductors are known to be very good positive (+) charging OPCs due to the hole (positive charge) transportability of the phthalocyanine pigment.

In these single-layer photoconductors, then, there is no need to add charge transport molecules, nor to have a separate charge transport layer. The phthalocyanine pigment content may be in the range of about 10 to 30 wt %, high enough to perform both charge generation and charge transport functions, with the binder content comprising the balance, i.e., in the range of about 90 to 70 wt %. The single photoconductor layer is usually more than about 3 micrometers ($\mu$m) thick in order to achieve the required charge acceptance and resulting image contrast.

It would be desirable to provide a phthalocyanine-type positive-charging OPC which exhibits stable electrical properties, including charge acceptance, dark decay and photodischarge, in a high cycle, high severity electrophotographic process, operating at elevated temperatures, on the order of about 35° to 75° C. Modern digital imaging systems wherein the writing head is an LED array or a laser diode have very high light intensities (about 2 to 3 mW/cm$^2$) over very short exposure time spans (less than 50 nanoseconds), resulting in severe conditions for the OPC compound compared to optical input copiers with light intensities between about 10 to 30 erg/cm$^2$ and exposure times between several hundred microseconds to milliseconds. These light sources operate in the range of about 700 to 1100 nm, which, due to the absorbance of the phthalocyanine compounds in the higher end of this range, is why these compounds are employed.

Unfortunately, there is no product on the market today which provides the stable electrical properties described above. This is because the phthalocyanine-type positive-charging OPC exhibits instability when it is frequently exposed to the corona charger and the intense light source in the electrophotographic process at elevated operating temperatures exceeding 35° C. The instability is more pronounced at the strong absorption, high light intensity, short exposure time conditions required for the laser printing process. The instability is exhibited in the significant increase of the dark decay after a small number of repeat cycles of laser printing. Also, the instability is exhibited in the decrease in surface potential. These instabilities cause deleterious changes in image contrast, and raise the issue of the reliability of image quality.

These instabilities in the phthalocyanine/binder photoconductor appear to be independent of the chemical structure or morphology of the pigment. Instead, they appear to be dependent on the nature of the contact between individual pigment particles. These are recent observations, and there is no published report or suggestion in the prior art of these observations or how to effectively address and solve the problem of photoconductor instability in the high cycle, high severity electrophotographic process.

Phthalocyanine pigments having specific morphology associated with particle size in sub-micrometer range have been observed to show different effects, depending on the type of the binder, such as agglomeration or aggregation. These properties are associated with the unstable dispersion of the pigment in the binder due to the poor compatibility between the two components. The above-mentioned unstable dispersion can cause the problem of non-uniformity of the coating, resulting in defects of the xerographic image quality, such as high noise and poor resolution. The poor dispersion of these pigments in binder also causes the unstable performance of the device, such as reduced life at different operating environments (ambient and elevated temperatures). The specific morphology with sub-micrometer particle size can be found in the following types of phthalocyanine pigments: the metal-free crystalline forms (a-, β-, τ-, and x-$H_2$-phthalocyanines), α-copper phthalocyanine, α-titanyl phthalocyanine, Y-titanyl phthalocyanine, amorphous titanyl phthalocyanine, α-tetrafluorotitanyl phthalocyanine, α-haloindium phthalocyanines (halo=Cl, Br, I, F), α-vanadyl phthalocyanine, α-zinc phthalocyanine, β-zinc phthalocyanine, x-magnesium phthalocyanine, α-chloro-alumium phthalocyanine, and hydroxygallium phthalocyanine.

When conventional binders for the phthalocyanine pigment which do not contain a hydroxy group, such as acrylic resins, vinyl polymers, including polyvinylacetate, polystyrene, polyesters, polyamides, polyimides, polycarbonates, methylmethacrylates, polyurethanes, polyureas, melamine resins, polysulfones, polyarylates, diallylphthalate resins, polyethylenes, and halogenated polymers, including polyvinylchloride, polyfluorocarbon, etc., are used, acceptable charge acceptance and photodischarge are obtained. However, among these polymers which result in good performance for charge acceptance and photodischarge, none of them exhibit the desirable thermal stability under the LED array or laser diode exposure conditions. Also, any binders, and accompanying solvents, which do not form a stable dispersion with the phthalocyanine pigment usually exhibit very low charge acceptance, high residual voltage, or dark decay, and are therefore unacceptable.

The conventional polymeric binders, such as polycarbonates, polyesters, phenoxy resin, phenolic resin, polystyrene, polyvinyl toluene, polyvinyl carbazole, polyimide, and the like, contain unsaturated rings. On the other hand, some functional groups in the binder, especially hydroxy groups (—OH) and thiols (—SH), as well as >NH, —$NH_2$, >N—, seem to exhibit strong interactions (e.g., hydrogen bonding) with the lone pair nitrogen of the phthalocyanine molecules. These interactions are observed to restrict the photoresponse of the photoconductor devices under space charge limited condition, such as exposing to strong light intensity in a very short time of several tens of nanoseconds.

Preferably, desirable electrophotographic performance may be defined as high charge acceptance of about 30 to 100 V/$\mu$m, low dark decay of less than about 5 V/sec, and photodischarge of at least 70% of surface charge with the laser diode beam of 780 nm or 830 nm frequency, through the optical system including beam scanner and focus lenses, synchronized at 0.05 msec for each beam.

Thus, there remains a need to provide binders for the positive single layer OPC using sub-micrometer morphology phthalocyanine pigment as a photoconductive element to satisfy (a) stable dispersion, (b) high photoresponse to laser exposure, and (c) stable performance over a wide range of elevated operating temperatures (about 35° to 75° C.).

DISCLOSURE OF INVENTION

In accordance with the invention, polymeric binders are provided for phthalocyanine pigments which comprise an aliphatic polymer or copolymer having a saturated ring for each repeat unit either included in the polymer chain or pendant therefrom and containing about 4 to 35 wt % of functional groups such as —OH, —SH, —N<, >NH, and —$NH_2$ per repeat unit of the polymer or copolymer.

The saturated ring portion, being essentially non-polar, or at least less polar than an unsaturated ring, maintains the specific morphology of the phthalocyanine pigments commonly employed in positive charge OPCs and results in a stable dispersion required for the stable performance of the OPC. Keeping the functional groups listed above to less than about 35 wt % ensures that the photoresponse is not reduced to an unacceptable level and that the dark decay is not increased. On the other hand, there must be at least about 4 wt % of the fuinctional groups present, since at a level of less than 4 wt %, the OPC exhibits poor thermal stability.

The aliphatic polymer or copolymer having saturated rings have the general chemical structure $$-(A)_m-(CR^1R^2-CR^3R^4)_n-(CR^5R^6-CR^7R^8-)_p \quad (1)$$

or

-continued $$-(CR^9(B)-CR^{10}R^{11})_m-(CR^1R^2-CR^3R^4)_n-(CR^5R^6-CR^7R^8-)_p \quad (2)$$

(a) where A is a saturated ring directly attached to the main chain of the aliphatic polymer or copolymer (1) and where B is a saturated ring not directly attached to the main chain, but rather to the subside of the polymer backbone (2), where A and B are either composed of $-(CH_2-)_q-$, where q=3–8, or $-(-CH_2-)_q-(-O-)_r-(-N)_s-$, or $-(-CH_2-)_q-(-S-)_r-$, where q=2–8, r=1–2, and s=0–1;

(b) where A and B may carry one or more functional groups R selected from the group consisting of alkyl, cycloalkyl, allyl;

(c) where $R^1$, $R^2$, $R^3$, $R^4$, $R^5$, $R^6$, $R^7$, $R^8$, $R^9$, $R^{10}$ and, $R^{11}$, are independently hydrogen, halogen (Cl, F, Br, I), alkyl, alkoxy, or allyl, with the proviso that at least one of $R^1$ to $R^{12}$ is —OH, —SH, >N—, >NH, and —$NH_2$, present in an amount within the range of about 4 to 35 wt % per repeat unit of the polymer or copolymer, subject to the optional presence of a thermal carrier generation control agent, described below; and (d) where m ranges from 0.15 to 1.0, and n and p each independently range from 0 to 0.85, with m+n+p=1.0.

Part or all of the —OH, —SH, >N—, >NH, and —$NH_2$ functionality may be provided by one or more thermal carrier generation control agents, which comprise a separate molecule added to the binder/pigment composite. The amount of such thermal carrier generation control agent(s) is sufficient to provide the concentration of the functional group in the range of about 4 to 35 wt % per repeat unit.

The pigment concentration in the total composite is maintained within the range of about 13 to 17 wt %.

The polymeric binders of the invention maintain the specific morphology of the previously-mentioned phthalocyanine pigments and result in a stable dispersion of the pigments required for the stable operation of the apparatus. Further, the improved single layer positive OPC evidences thermal stability of electronic properties, such as dark decay, at the elevated temperatures of about 35° to 75° C.

BEST MODES FOR CARRYING OUT THE INVENTION

Formulating composites comprising polymeric binders and the above-mentioned phthalocyanine pigments, in which the polymeric binders contain saturated rings which are less polar or are non-polar, can maintain the specific morphology of the phthalocyanine pigments and result in a stable dispersion required for the stable performance of the device, especially at elevated temperatures exceeding 35° C. The content of the functional groups —OH, —SH, —N<, >NH, and —$NH_2$ in the composite, which cause the reduced photoresponse, must be kept below about 35% per repeat unit of the polymer. This type of specific binder containing saturated rings exhibits the general chemical structure described below:

$$-(A)_m-(CR^1R^2-CR^3R^4)_n-(CR^5R^6-CR^7R^8)_p- \quad (1)$$

-continued or (2)

$$-(CR^9(B)-CR^{10}R^{11})_m-(CR^1R^2-CR^3R^4)_n-(CR^5R^6-CR^7R^8-)_p$$

(a) where A is a saturated ring directly attached to the main chain of the aliphatic polymer or copolymer (1) and where B is a saturated ring not directly attached to the main chain, but rather to the subside of the polymer backbone (2), where A and B are either composed of $-(-CH_2-)_q-$, where q=3–8, or $-(-CH_2-)_q-(-O-)_r-(-N)_s-$, or $-(-CH_2-)_q-(-S-)_r-$, where q=2–8, r=1–2, and s=0–1;

(b) where A and B may carry one or more functional groups R selected from the group consisting of alkyl, cycloalkyl, allyl;

(c) where $R^1$, $R^2$, $R^3$, $R^4$, $R^5$, $R^6$, $R^7$, $R^8$, $R^9$, $R^{10}$ and, $R^{11}$, are independently hydrogen, halogen (Cl, F, Br, I), alkyl, alkoxy, or allyl, with the proviso that at least one of $R^1$ to $R^{12}$ is —OH, —SH, >N—, >NH, and $—NH_2$, present in an amount within the range of about 4 to 35% per repeat unit of the polymer or copolymer, subject to the optional presence of a thermal carrier generation control agent, described below; and (d) where m ranges from 0.15 to 1.0, and n and p each independently range from 0 to 0.85, with m+n+p=1.0.

The various functional groups R and $R^1$–$R^{12}$ and various substituent functional groups are those commonly employed in the polymer art. The A and B saturated rings are well-known, and their incorporation in the polymer chain is accomplished by methods known in the polymer art.

Examples of A saturated rings include:

(A-1)

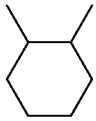

(A-2)

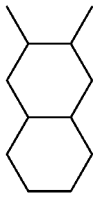

(A-3)

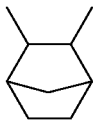

(A-4)

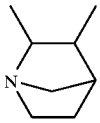

-continued (A-5)

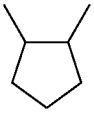

(A-6)

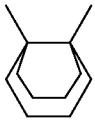

(A-7)

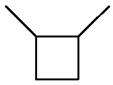

(A-8)

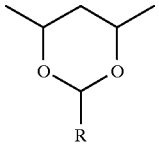

where R is hydrogen or alkyl, (A-9)

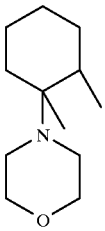

(A-10)

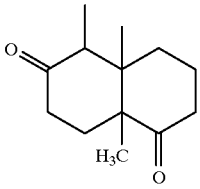

(A-11)

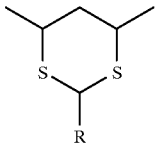

where R is hydrogen or alkyl, (A-12)

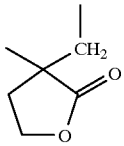

-continued
(A-13)
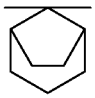
Examples of B saturated rings include:
(B-1)
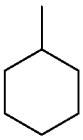
(B-2)
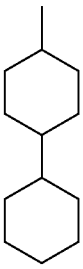
(B-3)
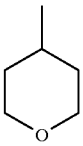
(B-4)
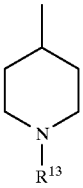
where $R^{13}$ is hydrogen, halogen, alkyl, alkoxy, or allyl,
(B-5)
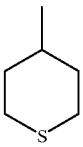
(B-6)
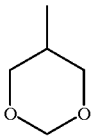
(B-7)
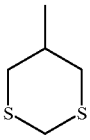
-continued
(B-8)
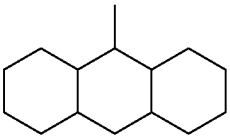
(B-9)
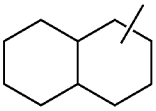
(B-10)
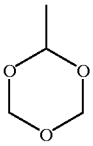
(B-11)
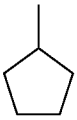
(B-12)
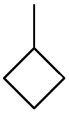
(B-13)
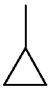
(B-14)
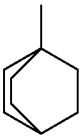
(B-15)
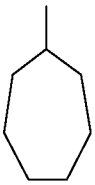
(B-16)
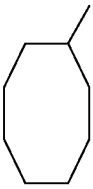
(B-17)
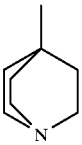

-continued (B-18)

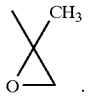

Specific examples of these polymers can be listed as follows:

(1) Polyvinyl butyrals

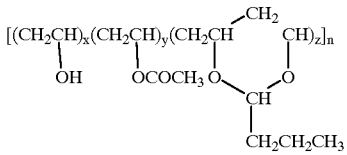

where n ranges from about 10 to 10,000, x is within a range such as to provide an —OH content within the range of about 4 to 35 wt % per repeat unit, y ranges from about 0.001 to 0.5, and z ranges from about 0.40 to 0.95, where the sum of x+y+z=1.0.

(2) Polyvinyl acetals

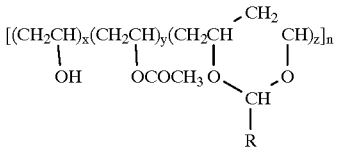

where R is $CH_3$, $C_2H_5$, $C_6H_5$, or $C_6H_5CH_2$ and where n, x, y, and z are as defined in (1) above.

(3) Polysaccharide

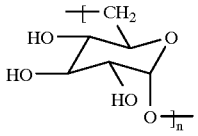

where n ranges from about 10 to 10,000.

(4) Polyvinylcyclohexane and its copolymers

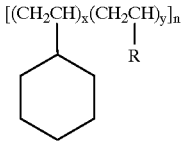

where R is alkyl, substituted alkyl, alkoxy, —OH, —SH, >N—, >NH, or —$NH_2$ (as —$CONH_2$) and where n ranges from about 5 to 20,000, x ranges from about 0.001 to 0.5, and y ranges from about 0.5 to 0.999, where the sum of x+y=1.0. Where R is at least one of the functional groups of —OH, —SH, >N—, >NH, and —$NH_2$, then y is within a range so as to provide a concentration of the functional group within the range of about 4 to 35 wt % per repeat unit. Where none of the functional groups required in the practice of the invention is present on the polymer, then the functional group is provided by one or more thermal carrier generation control agents, as described below.

(5) Polycyclohexane and its copolymers

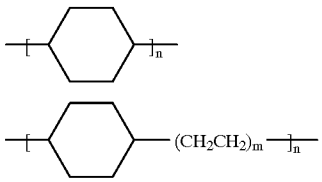

where n ranges from about 5 to 20,000, and m ranges from 1 to 10. In this instance, the functional group required in the practice of the invention is provided by one or more thermal carrier generation control agents, as described below.

As indicated above, the amount of —OH, —SH, —$NH_2$, >NH, and >N— ranges from about 4 to 35 wt % per repeat unit of the polymeric or copolymeric binder. There must be some amount of functional group present, in order to provide thermal stability to the phthalocyanine pigment in the temperature range of about 35° to 75° C. However, a value of greater than about 35 wt % results in poor photoconductive properties of the pigment, such as increasing the dark decay of the OPC.

The amount of the functional group is controllable by baking the OPC at a temperature and for a time that depends on the thickness of the layer and the amount of functional group. In general, the temperature is within the range of about 80° C. to 300° C. and the time of heating is within the range of about several seconds to several hours. The heating causes chemical reaction or cross-linking, depending on the presence of other substituents, thereby reducing the content of the functional group.

The photoconductive phthalocyanine pigment has a particle size less than about 1 $\mu$m and is substantially uniformly dispersed in the polymeric binder. The uniform dispersion is judged by the glossiness of the finished surface. Preferably, the phthalocyanine pigments employed in the practice of the invention are those previously mentioned above.

A single layer positive OPC may be fabricated employing the polymeric binder of the invention by combining the pigment and the polymeric binder, and, optionally, one or more thermal carrier generation control agents, to form a composite. No charge transport molecule is present in such a configuration, as is well-known.

While as discussed above, the presence of the functional groups —OH, —SH, >N—, >NH, and —$NH_2$ is required in the amount of about 4 to 35% per repeat unit of polymer, these functional groups can be provided in whole or in part by the addition of specific chemicals, herein called thermal carrier generation control agents, which include such functional groups, so that the total of these functional groups, whether on binder or on thermal carrier generation control agent(s) or both, remains within the required range. These functional groups form weak bondings with the nitrogen atoms or with the chelate metal of the phthalocyanine molecule. Examples of classes of thermal carrier generation control agents useful in the practice of the present invention include primary, secondary, and tertiary amines and amine derivatives, with tertiary amines providing the weakest activity in terms of thermal carrier generation control and primary amines providing the strongest activity. Additional examples include ketals, carboxaldehydes, and sulfones having at least one of the functional groups —OH, —SH, >N—, >NH, and —$NH_2$. Specific examples of thermal carrier generation control agents include the following (available from Aldrich Chemical, with reference to the 1994–95 catalogue): 1-methylhydatoin (p. 960, Cat. No. M4,988-7), 4-methyl-5-imidazole-carboxaldehyde (p. 961, Cat. No. 39,215-4), 4,5-diamino-2,6-dimercaptopyrimidine (p. 435, Cat. No. D,1540-5), 2,4-diamino-6-hydroxypyrimidine (p. 436, Cat. No. D,1920-6), dibenzosuberenol (p. 443, Cat. No. D3,172-9), methyl-4-methoxy-2-indolecarboxylate (p. 967, Cat. No. 36,556-4), 3,4-dihydro-3-methyl-2(1H)-quinazolinone (p. 520, Cat. No. 41,877-3), 3',5'-dihydroxyacetophenone (p. 523, Cat. No 22,459-6), 1,8-dihydroxyanthraquinone (p. 524, Cat. No. D10,810-3), 2,4-dihydroxy-5,6-dimethylpyrimidine (p. 526, Cat. No. 16,536-0), and 4,6-dihydroxy-2-mercaptopyrimidine (p. 526, Cat. No. D11,350-6).

The decision whether to employ a thermal carrier generation control agent in part or in whole is dictated, at least in part, by the nature of the crystalline form of the pigment. Some crystalline forms have an inherent higher dark decay than others, and it is when such crystalline forms having higher dark decay are utilized as pigments that the thermal carrier generation control agent may be employed, in whole or in part. In any event, the amount of such thermal carrier generation control agent present is such as to provide a total amount of the functional group in the composite that is within the range of about 4 to 35 wt % per polymer repeat unit.

The amount of pigment in the composite is in the range of about 13 to 17 wt %, the balance the binder. The addition of thermal control agent(s), if used, does not alter the ratio in the composite. It is noted that pigment concentrations above about 17 wt % result in an unacceptable increase in dark decay. Without subscribing to any particular theory, it appears that as the pigment concentration is increased, more pigment on the surface of the OPC is exposed to the air, which, in the vicinity of the corona, has a high concentration of ozone. The ozone oxidizes the pigment faster than oxygen in the air, and this oxidation results in increased dark decay, particularly at elevated temperatures above 35° C.

EXAMPLES

Comparative Example 1

The crystalline (x) form of phthalocyanine (Pc), x-$H_2$Pc, in a matrix of an unsaturated polymer binder, high molecular weight polycarbonate dispersion (Makrolon™, available from Mobile Chemical Co.), in which the amount of x-$H_2$Pc was 16 wt % and the amount of polycarbonate was 84 wt %, exhibited a non-glossy surface (agglomeration of pigment) and significantly reduced charge acceptance after 7.5K cycles at the lab ambient.

The initial charge acceptance was about 550 V, but after 7.5K cycles had a value of about 150 V, which meant that the OPC no longer accepted charge well.

Comparative Example 2 x-$H_2$Pc (16% wt) in unsaturated ring binder comprising phenoxy resin (PKHH, available from Union Carbide) containing 18% —OH groups exhibited low laser response plus significant reduction of charge acceptance after 10K life test at the lab ambient.

Specifically, the dark decay initially was 3 V/sec; after 10K cycles, the dark decay was 10 V/sec, which meant that the OPC did not hold a charge well. Also, the initial charge acceptance was 550 V, but dropped to 200 V after 10K cycles due to poor dispersion.

Example 1 x-$H_2$Pc (16% wt) in polyvinyl butyral (PVB) with 5% content of —OH exhibited excellent dispersion and relatively high laser response, with a slight change of charge acceptance after 10K life test at the lab ambient.

Example 2

Example 1 was repeated except that increasing the dispersion time from 48 hr ball milling to 78 hr resulted in a more stable charge acceptance after 10K life test.

Example 3

Example 1 was repeated except that a quick dry (<8 min) at higher temperature (150° to 230° C.) was done in order to lower the content of —OH from the partial cross-linking of the PVB in the surface to yield a reduced change of charge acceptance after 10K life test at 50° C., i.e, increased thermal stability and laser response.

Example 4 x-$H_2$Pc (16% wt) with a PVB binder containing 33% of —OH exhibited good dispersion, slower laser response, and very little change of charge acceptance after 10K life test at the lab ambient.

Example 5

Example 4 was repeated except that the OPC was baked quickly (<8 min) at high temperature (150° to 225° C.) to cause a partial cross-linking, which reduced —OH content from 33% to 15%. Higher laser response and very little change of charge acceptance after 10K life test at 50° C. were observed. This result shows a balance of —OH can maintain good laser response and better thermal stability.

Examples 6–10

Example 1 was repeated with different pigment contents and dark decay was measured as a rate of changing surface potential $V_0$ (volts) during 10 seconds. Dark decay rate (DDR) is defined by:

$$DDR=[V(0)-V(10)]/10[V/s]$$

V(10)=the surface potential after 10 seconds in dark

V(0)=the initial surface potential.

The measurement was carried out with a Hewlett-Packard prototype laser printer. The photoconductor rotated with a speed of 3 inches/sec and the corona charger was set at +600 V.

Also, in order to confirm the acceptable level of the dark decay, the photoconductor was exposed to a laser print head monitored at 780 nm and 1 mW output. The latent image, then, was developed with a black liquid toner (Versatec Black, toner concentration 2% solid) using a development bias set at +450 V. The toner image, then, was electrostatically transferred into a white plain paper using a transfer bias set at −550 V. The high dark decay photoconductor exhibited a high level of background development and poor contrast. The background density was measured with a Mac-beth densitometer. These results are illustrated in the Table below.

| Example | Pigment Content (%) | $V_0$(V) | DDR (V/s) | Image Density | Back-ground Density | Notes |
|---|---|---|---|---|---|---|
| 6 | 10% | 590 | 3.0 | 0.8 | 0.01 | Image density was low due to poor sensitivity of the OPC |
| 7 | 13% | 560 | 3.5 | 1.34 | 0.01 | Image density was better due to increased sensitivity |
| 8 | 17% | 535 | 4.0 | 1.34 | 0.015 | |
| 9 | 20% | 480 | 8.0 | 1.40 | 0.2 | The dark decay was higher and the background density increased 10x |
| 10 | 30% | 440 | 9.0 | 1.41 | 0.3 | |

So, it is obvious that in the case of a single layer using phthalocyanine pigment as the photoconductive element, a pigment content greater than about 17 wt % tends to show an increased dark decay which is related to the increase of undesirable background density of the developed image by liquid toner.

The same phenomenon was observed with a binder having hydroxy content greater than 35 wt %.

These phenomena were observed at elevated temperatures above 35° C.

INDUSTRIAL APPLICABILITY

The positive organic photoconductor comprising phthalocyanine pigment and binder of the invention is expected to find use in electrophotographic printing, particularly in color electrophotographic printing.

Thus, there has been disclosed an improved binder for use with phthalocyanine pigments in electrophotographic printing. It will be readily apparent to those skilled in this art that various changes and modifications of an obvious nature may be made without departing from the scope of the invention, which is defined by the appended claims.

What is claimed is:

1. A single layer positive organic photoconductor comprising a composite comprising at least one photoconductive phthalocyanine pigment having a particle size less than about 1 $\mu$m and substantially uniformly dispersed in a polymeric binder, said phthalocyanine pigment including nitrogen atoms in its structure and, optionally, a chelate metal, and said polymeric binder formed from an aliphatic polymer or copolymer having a main chain, with a saturated ring depending therefrom, said composite further comprising at least one functional group which can form weak bondings with nitrogen atoms or with chelate metals of said phthalocyanine pigment, said at least one functional group selected from the group consisting of —OH, —SH, >N—, >NH, and —$NH_2$, said at least one functional group provided by at least one of said binder and at least one separate thermal carrier generation control agent, or both, and present in an amount within the range of about 4 to 35 wt % per repeat unit of said polymer or copolymer so as to provide thermal stability of electronic properties of said organic photoconductor in the temperature range of about 35° to 75° C., said at least one pigment being present in an amount within the range of 13 to 17 wt % of said composite, wherein said polymeric binder has a general chemical structure given by $$-(CR^9(B)-CR^{10}R^{11})_m-(CR^1R^2-CR^3R^4)_n-(CR^5R^6-CR^7R^8)_p-$$

(a) where B is a saturated ring dependent from said main chain and is composed of
—(—$CH_2$—)$_q$—, where q=3–8, or
—(—$CH_2$—)$_q$—(—O—)—(—N—)$_s$ or
—(—$CH_2$—)$_q$—(—S—)$_r$—, where q=2–8, r=1–2, and s=0–1;

(b) where B may be substituted by at least one functional group R selected from the group consisting of alkyl, cycloalkyl, and allyl;

(c) where $R^1$, $R^2$, $R^3$, $R^4$, $R^5$, $R^6$, $R^7$, $R^8$, $R^9$, $R^{10}$, and $R^{11}$ are independently —OH, —SH, >N—, >NH, —$NH_2$, hydrogen, halogen, alkyl, alkoxy, or allyl; and (d) where m ranges from 0.15 to 1.0, and n and p each independently range from 0 to 0.85, with m+n+p=1.0.

2. The single layer positive organic photoconductor of claim 1 wherein said phthalocyanine pigment is selected from the group consisting of x-$H_2$-phthalocyanine, $\alpha$-$H_2$-phthalocyanine, $\tau$-$H_2$-phthalocyanine, $\beta$-$H_2$-phthalocyanine, $\alpha$-copper phthalocyanine, $\alpha$-titanyl phthalocyanine, Y-titanyl phthalocyanine, amorphous titanyl phthalocyanine, $\alpha$-tetrafluorotitanyl phthalocyanine, $\alpha$-haloindium phthalocyanines, $\alpha$-vanadyl phthalocyanine, $\alpha$-zinc phthalocyanine, $\beta$-zinc phthalocyanine, x-magnesium phthalocyanine, $\alpha$-chloroaluminum phthalocyanine, and hydroxygallium phthalocyanine.

3. The single layer positive organic photoconductor of claim 1 wherein said thermal carrier generation control agent is selected from the group consisting of primary, secondary, and tertiary amines, and ketals, carboxaldehydes, and sulfones having at least one of the functional groups —OH, —SH, >N—, >NH, and —$NH_2$.

4. The single layer positive organic photoconductor of claim 3 wherein said thermal carrier generation control agent is selected from the group consisting of 1-methylhydatoin, 4-methyl-5-imidazolecarboxaldehyde, 4,5-diamino-2,6-dimercaptopyrimidine, 2,4-diamino-6-hydroxypyrimidine, dibenzosuberenol, methyl-4-methoxy-2-indolecarboxylate, 3,4-dihydro-3-methyl-2(1H)-quinazolinone, 3',5'-dihydroxyacetophenone, 1,8-dihydroxyanthraquinone, 2,4-dihydroxy-5,6-dimethylpyrimidine, and 4,6-dihydroxy-2-mercaptopyrimidine.

5. A single layer positive organic photoconductor comprising a composite comprising at least one photoconductive phthalocyanine pigment having a particle size less than about 1 $\mu$m and substantially uniformly dispersed in a polymeric binder, said phthalocyanine pigment including nitrogen atoms in its structure and, optionally, a chelate metal, and said polymeric binder formed from an aliphatic polymer or copolymer having a main chain, with a saturated ring in said main chain, said composite further comprising at least one functional group which can form weak bondings with nitrogen atoms or with chelate metals of said phthalocyanine pigment, said at least one functional group selected from the group consisting of —OH, —SH, >N—, >NH, and —$NH_2$, said at least one functional group provided by either (1) at least one separate thermal carrier generation control agent or (2) said at least one separate thermal carrier generation control agent and said polymeric binder, said at least one functional group present in an amount within the range of about 4 to 35 wt % per repeat unit of said polymer or copolymer so as to provide thermal stability of electronic properties of said organic photoconductor in the temperature range of about 35° to 75° C., said at least one pigment being present in an amount within the range of 13 to 17 wt % of said composite, wherein said polymeric binder has a general chemical structure given by $$-(-A-)_m-(-CR^1R^2-CR^3R^4-)_n-(-CR^5R^6-CR^7R^8-)_p-$$

(a) where A is a saturated ring directly attached to said main chain and is composed of
$-(-CH_2-)_q-$, where q=3–8, or
$-(-CH_2-)_q-(-O-)_r-(-N-)_s-$ or
$-(-CH_2-)_q-(-S-)_r-$, where q=2–8, r=1–2, and s=0–1;

(b) where A may be substituted by at least one functional group R selected from the group consisting of alkyl, cycloalkyl, and allyl;

(c) where $R^1$, $R^2$, $R^3$, $R^4$, $R^5$, $R^6$, $R^7$, $R^8$, $R^9$, $R^{10}$, and $R^{11}$ are independently —OH, —SH, >N—, >NH, $—NH_2$, hydrogen, halogen, alkyl, alkoxy, or allyl;

(d) where m ranges from 0.15 to 1.0, and n and p each independently range from 0 to 0.85, with m+n+p=0.1.

6. The single layer positive organic photoconductor of claim 5 wherein said phthalocyanine pigment is selected from the group consisting of x-$H_2$-phthalocyanine, α-$H_2$-phthalocyanine, τ-$H_2$-phthalocyanine, β-$H_2$-phthalocyanine, α-copper phthalocyanine, α-titanyl phthalocyanine, Y-titanyl phthalocyanine, amorphous titanyl phthalocyanine, α-tetrafluorotitanyl phthalocyanine, α-haloindium phthalocyanines, α-vanadyl phthalocyanine, α-zinc phthalocyanine, β-zinc phthalocyanine, x-magnesium phthalocyanine, α-chloroaluminum phthalocyanine, and hydroxygallium phthalocyanine.

7. The single layer positive organic photoconductor of claim 5 wherein said thermal carrier generation control agent is selected from the group consisting of primary, secondary, and tertiary amines, and ketals, carboxaldehydes, and sulfones having at least one of the functional groups —OH, —SH, >N—, >NH, and $—NH_2$.

8. The single layer positive organic photoconductor of claim 7 wherein said thermal carrier generation control agent is selected from the group consisting of 1-methylhydatoin, 4-methyl-5-imidazolecarboxaldehyde, 4,5-diamino-2,6-dimercaptopyrimidine, 2,4-diamino-6-hydroxypyrimidine, dibenzosuberenol, methyl-4-methoxy-2-indolecarboxylate, 3,4-dihydro-3-methyl-2(1H)-quinazolinone, 3',5'-dihydroxyacetophenone, 1,8-dihydroxyanthraquinone, 2,4-dihydroxy-5,6-dimethylpyrimidine, and 4,6-dihydroxy-2-mercaptopyrimidine.

9. A method of providing thermal stability of electronic properties of a single layer positive organic photoconductor at elevated temperatures within the range of about 35° to 75° C., said single layer positive organic photoconductor comprising a phthalocyanine pigment having a particle size less than about 1 μm and substantially uniformly dispersed in a polymeric binder to form a composite, said polymeric binder formed from a polymer or copolymer having a main chain, with a saturated ring depending therefrom, said method comprising formulating said composite with at least one functional group selected from the group consisting of —OH, —SH, >N—, >NH, and $—NH_2$, said formulating accomplished either by providing said functional group on said polymeric binder or as a separate thermal carrier generation control agent, or both, in an amount so as to provide said composite with a concentration of said functional group within the range of about 4 to 35 wt % per polymer or copolymer repeat unit, wherein said separate thermal carrier generation control agent is selected from the group consisting of primary, secondary, and tertiary amines, ketals, carboxaldehydes, and sulfones having at least one of said functional groups, and adding said at least one pigment to said binder in an amount of 13 to 17 wt % of said composite, wherein said polymeric binder has a general chemical structure given by $$-(CR^9-CR^{10}R^{11})_m-(CR^1R^2-CR^3R^4)_n-(CR^5R^6-CR^7R^8)_p-$$
$$\quad |$$
$$\quad B$$

(a) where B is a saturated ring dependent from said main chain and is composed of
$-(-CH_2-)_q-$, where q=3–8, or
$-(-CH_2-)_q-(-O-)_r-(-N-)_s$ or
$-(-CH_2-)_q-(-S-)_r-$, where q=2–8, r=1–2, and s=0–1;

(b) where B may be substituted by at least one functional group R selected from the group consisting of alkyl, cycloalkyl, and allyl;

(c) where $R^1$, $R^2$, $R^3$, $R^4$, $R^5$, $R^6$, $R^7$, $R^8$, $R^9$, $R^{10}$, and $R^{11}$ are independently —OH, —SH, >N—, >NH, $—NH_2$, hydrogen, halogen, alkyl, alkoxy, or allyl; and (d) where m ranges from 0.15 to 1.0, and n and p each independently range from 0 to 0.85, with+n+p=1.0.

10. The method of claim 9 wherein said thermal carrier generation control agent is selected from the group consisting of 1-methylhydatoin, 4-methyl-5-imidazolecarboxaldehyde, 4,5-diamino-2,6-dimercaptopyrimidine, 2,4-diamino-6-hydroxypyrimidine, dibenzosuberenol, methyl-4-methoxy-2-indolecarboxylate, 3,4-dihydro-3-methyl-2(1H)-quinazolinone, 3',5'-dihydroxyacetophenone, 1,8-dihydroxyanthraquinone, 2,4-dihydroxy-5,6-dimethylpyrimidine, and 4,6-dihydroxy-2-mercaptopyrimidine.

11. The method of claim 9 wherein said concentration of said functional group is provided by heating said composite to a temperature ranging from about 80° to 300° C. for a period of time ranging from several seconds to several hours, said heating leaving a concentration of at least about 4% of said functional groups when completed.

12. The method of claim 9 wherein said at least one functional group is attached to said polymeric binder.

13. The method of claim 9 wherein said at least one functional group is attached to at least one said thermal carrier generation control agent.

14. A method of providing thermal stability of electronic properties of a single layer positive organic photoconductor at elevated temperatures within the range of about 35° to 75° C., said single layer positive organic photoconductor comprising a phthalocyanine pigment having a particle size less than about 1 μm and substantially uniformly dispersed in a polymeric binder to form a composite, said polymeric binder formed from a polymer or copolymer having a main chain, with a saturated ring in said main chain, said method comprising formulating said composite with at least one functional group selected from the group consisting of —OH, —SH, >N—, >NH, and $—NH_2$, said formulating accomplished by providing said functional group on either (1) at least one separate thermal carrier generation control agent or (2) said at least one separate thermal carrier generation control agent and said polymeric binder, said at least one functional group present in an amount so as to provide said composite with a concentration of said functional group within the range of about 4 to 35 wt % per polymer or copolymer repeat unit, wherein said separate thermal carrier generation control agent is selected from the group consisting of primary, secondary, and tertiary amines, ketals, carboxaldehydes, and sulfones having at least one of said functional groups, and adding said at least one pigment to said binder in an amount of 13 to 17 wt % of said composite, wherein said polymeric binder has a general chemical structure given by $$—(—A—)_m—(—CR^1R^2—CR^3R^4—)_n—(—CR^5R^6—CR^7R^8—)_p—$$

(a) where A is a saturated ring directly attached to said main chain and is composed of
$—(—CH_2—)_q—$, where q=3–8, or
$—(—CH_2—)_q—(—O—)_r—(—N—)_s$ or
$—(—CH_2—)_q—(—S—)_r—$, where q=2–8, r=1–2, and s=0–1;

(b) where A may be substituted by at least one functional group R selected from the group consisting of alkyl, cycloalkyl, and allyl;

(c) where $R^1$, $R^2$, $R^3$, $R^4$, $R^5$, $R^6$, $R^7$, $R^8$, $R^9$, $R^{10}$, and $R^{11}$ are independently —OH, —SH, >N—, >NH, $—NH_2$, hydrogen, halogen, alkyl, alkoxy, or allyl; and (d) where m ranges from 0.15 to 1.0, and n and p each independently range from 0 to 0.85, with+n+p=1.0.

15. The method of claim 14 wherein said thermal carrier generation control agent is selected from the group consisting of 1-methylhydatoin, 4-methyl-5-imidazolecarboxaldehyde, 4,5-diamino-2,6-dimercaptopyrimidine, 2,4-diamino-6-hydroxypyrimidine, dibenzosuberenol, methyl-4-methoxy-2-indolecarboxylate, 3,4-dihydro-3-methyl-2(1H)-quinazolinone, 3',5'-dihydroxyacetophenone, 1,8-dihydroxyanthraquinone, 2,4-dihydroxy-5,6-dimethyl-pyrimidine, and 4,6-dihydroxy-2-mercaptopyrimidine.

16. A single layer positive organic photoconductor comprising a composite comprising at least one photoconductive phthalocyanine pigment having a particle size less than about 1 $\mu$m and substantially uniformly dispersed in a polymeric binder, said phthalocyanine pigment including nitrogen atoms in its structure and, optionally, a chelate metal, and said polymeric binder formed from an aliphatic polymer or copolymer having a main chain, with a saturated ring either in said main chain or depending therefrom, said composite further comprising at least one functional group which can form weak bondings with nitrogen atoms or with chelate metals of said phthalocyanine pigment, said at least one functional group selected from the group consisting of —OH, —SH, >N—, >NH, and $—NH_2$, said at least one functional group provided by at least one of said binder and at least one separate thermal carrier generation control agent, or both, and present in an amount within the range of about 4 to 35 wt % per repeat unit of said polymer or copolymer so as to provide thermal stability of electronic properties of said organic photoconductor in the temperature range of about 35° to 75° C., said at least one pigment being present in an amount within the range of 13 to 17 wt % of said composite, wherein said binder is selected from the group consisting of (1) polysaccharides given by the formula

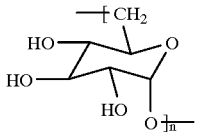

where n ranges from about 10 to 10,000;

(2) polyvinylcyclohexane and its copolymers given by the formula

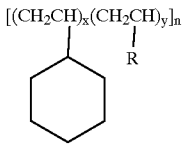

where R is alkyl, substituted alkyl, alkoxy, —OH, —SH, >N—, >NH, or $—CONH_2$ and where n ranges from about 5 to 20,000, x ranges from about 0.001 to 0.5, and y ranges from about 0.5 to 0.999, where the sum of x+y=1.0, with the proviso that where one of the functional groups of —OH, —SH, >N—, >NH, and $—CONH_2$ is present, then y is within a range so as to provide a concentration of the functional group within the range of about 4 to 35 wt % per repeat unit; and (3) polycyclohexane and copolymers thereof given by the formula

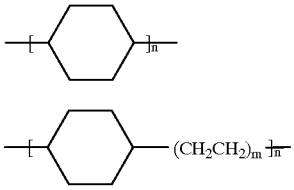

where n ranges from about 5 to 20,000, and m ranges from 1 to 10.

17. The single layer positive organic photoconductor of claim 16 wherein said thermal carrier generation control agent is selected from the group consisting of primary, secondary, and tertiary amines, and ketals, carboxaldehydes, and sulfones having at least one of the functional groups —OH, —SH, >N—, >NH, and $—NH_2$.

18. The single layer positive organic photoconductor of claim 17 wherein said thermal carrier generation control agent is selected from the group consisting of 1-methylhydatoin, 4-methyl-5-imidazolecarboxaldehyde, 4,5-diamino-2,6-dimercapto-pyrimidine, 2,4-diamino-6-hydroxypyrimidine, dibenzosuberenol, methyl-4-methoxy-2-indolecarboxylate, 3,4-dihydro-3-methyl-2(1H)-quinazolinone, 3',5'-dihydroxyacetophenone, 1,8-dihydroxyanthraquinone, 2,4-dihydroxy-5,6-dimethylpyrimidine, and 4,6-dihydroxy-2-mercaptopyrimidine.

19. A single layer positive organic photoconductor comprising a composite comprising at least one photoconductive phthalocyanine pigment having a particle size less than about 1 $\mu$m and substantially uniformly dispersed in a polymeric binder, said phthalocyanine pigment including nitrogen atoms in its structure and, optionally, a chelate metal, and said polymeric binder being selected from the group consisting of (a)

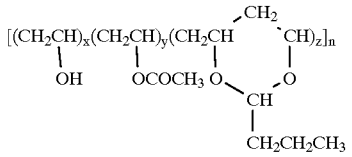

where n ranges from about 10 to 10,000, x is within a range such as to provide an —OH content within the range of about 4 to 35 wt % per repeat unit, y ranges from about 0.001 to 0.5, and z ranges from about 0.40 to 0.95, where the sum of x+y+z=1.0, and (b)

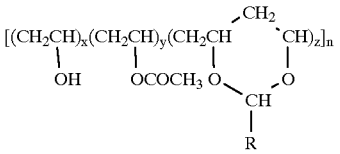

where R is $CH_3$, $C_2H_5$, $C_6H_5$, or $C_6H_5CH_2$ and where n ranges from about 10 to 10,000, x is within a range such as to provide an —OH content within the range of about 4 to 35 wt % per repeat unit, y ranges from about 0.001 to 0.5, and z ranges from about 0.40 to 0.95, where the sum of x+y+z=1.0, said composite further including at least one separate thermal carrier generation control agent containing at least one functional group selected from the group consisting of —OH, —SH, >N—, >NH, and —$NH_2$ and present in an amount within the range of about 4 to 35 wt % per repeat unit of said polymer or copolymer so as to provide thermal stability of electronic properties of said organic photoconductor in the temperature range of about 35° to 75° C., said at least one pigment being present in an amount within the range of 13 to 17 wt % of said composite.

20. The single layer positive organic photoconductor of claim 19 wherein said thermal carrier generation control agent is selected from the group consisting of primary, secondary, and tertiary amines, and ketals, carboxaldehydes, and sulfones having at least one of the functional groups —OH, —SH, >N—, >NH, and —$NH_2$.

21. The single layer positive organic photoconductor of claim 20 wherein said thermal carrier generation control agent is selected from the group consisting of 1-methylhydatoin, 4-methyl-5-imidazolecarboxaldehyde, 4,5-diamino-2,6-dimercapto-pyrimidine, 2,4-diamino-6-hydroxypyrimidine, dibenzosuberenol, methyl-4-methoxy-2-indolecarboxylate, 3,4-dihydro-3-methyl-2(1H)-quinazolinone, 3',5'-dihydroxyaceto-phenone, 1,8-dihydroxyanthraquinone, 2,4-dihydroxy-5,6-dimethylpyrimidine, and 4,6-dihydroxy-2-mercaptopyrimidine.

22. A single layer positive organic photoconductor comprising a composite comprising at least one photoconductive phthalocyanine pigment having a particle size less than about 1 $\mu$m and substantially uniformly dispersed in a polymeric binder, said phthalocyanine pigment including nitrogen atoms in its structure and, optionally, a chelate metal, and said polymeric binder formed from an aliphatic polymer or copolymer having a main chain, with a saturated ring depending therefrom, said composite further comprising at least one functional group which can form weak bondings with nitrogen atoms or with chelate metals of said phthalocyanine pigment, said at least one functional group selected from the group consisting of —OH, —SH, >N—, >NH, and —$NH_2$, said at least one functional group provided by at least one of said binder and at least one separate thermal carrier generation control agent, or both, and present in an amount within the range of about 4 to 35 wt % per repeat unit of said polymer or copolymer so as to provide thermal stability of electronic properties of said organic photoconductor in the temperature range of about 35° to 75° C., said at least one pigment being present in an amount within the range of 13 to 17 wt % of said composite, wherein said polymeric binder has a general chemical structure given by

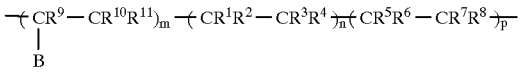

(a) where B is selected from the group consisting of (B-1)

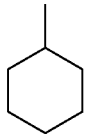

(B-2)

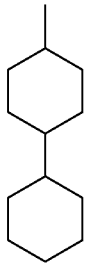

(B-3)

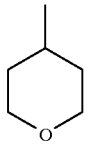

(B-4)

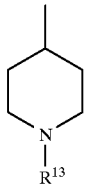

where $R^{13}$ is hydrogen, halogen, alkyl, alkoxy, or allyl, (B-5)

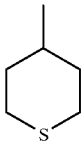

-continued (B-6)

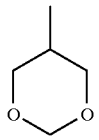

(B-7)

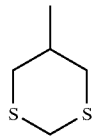

(B-8)

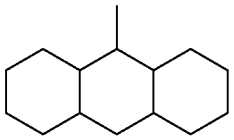

(B-9)

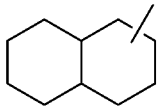

(B-10)

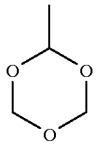

(B-11)

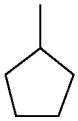

(B-12)

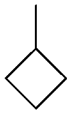

(B-13)

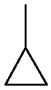

(B-14)

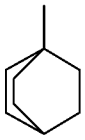

(B-15)

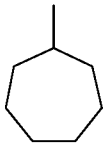

-continued (B-16)

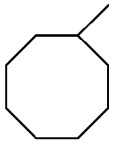

(B-17)

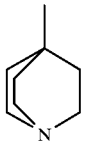

(B-18)

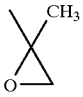

(b) where $R^1$, $R^2$, $R^3$, $R^4$, $R^5$, $R^6$, $R^7$, $R^8$, $R^9$, $R^{10}$, and $R^{11}$ are independently —OH, —SH, >N—, >NH, —$NH_2$, hydrogen, halogen, alkyl, alkoxy, or allyl; and (c) where m ranges from 0.15 to 1.0, and n and p each independently range from 0 to 0.85, with m+n+p=1.0.

23. A single layer positive organic photoconductor comprising a composite comprising at least one photoconductive phthalocyanine pigment having a particle size less than about 1 $\mu$m and substantially uniformly dispersed in a polymeric binder, said phthalocyanine pigmnent including nitrogen atoms in its structure and, optionally, a chelate metal, and said polymeric binder formed from an aliphatic polymer or copolymer having a main chain, with a saturated ring in said main chain, said composite further comprising at least one functional group which can form weak bondings with nitrogen atoms or with chelate metals of said phthalocyanine pigment, said at least one functional group selected from the group consisting of —OH, —SH, >N—, >NH, and —$NH_2$, said at least one functional group provided by either (1) at least one separate thermal carrier generation control agent or (2) said at least one separate thermal carrier generation control agent and said polymeric binder, said at least one functional group present in an amount within the range of about 4 to 35 wt % per repeat unit of said polymer or copolymer so as to provide thermal stability of electronic properties of said organic photoconductor in the temperature range of about 35° to 75° C., said at least one pigment being present in an amount within the range of 13 to 17 wt % of said composite, wherein said polymeric binder has a general chemical structure given by $$—(—A—)_m—(—CR^1R^2—CR^3R^4—)_n—(—CR^5R^6—CR^7R^8—)_p—$$

(a) where A is selected from the group consisting of (A-1)

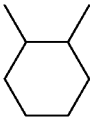

-continued
(A-2)
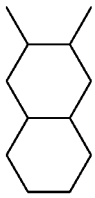
(A-3)
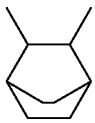
(A-4)
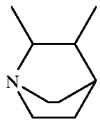
(A-5)
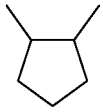
(A-6)
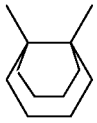
(A-7)
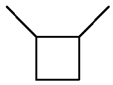
(A-8)
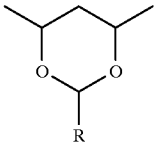
where R is hydrogen or alkyl,
(A-9)
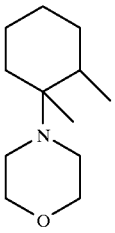
(A-10)
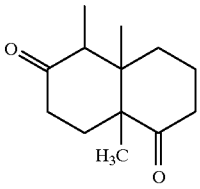
(A-11)
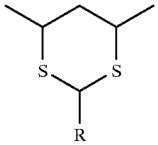
where R is hydrogen or alkyl,
(A-12)
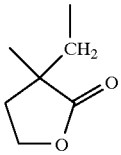
(A-13)
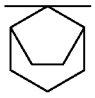
(b) where $R^1$, $R^2$, $R^3$, $R^4$, $R^5$, $R^6$, $R^7$, $R^8$, $R^9$, $R^{10}$, and $R^{11}$ are independently —OH, —SH, >N—, >NH, —$NH_2$, hydrogen, halogen, alkyl, alkoxy, or allyl;
(c) where m ranges from 0.15 to 1.0, and n and p each independently range from 0 to 0.85, with m+n+p=1.0.
* * * * *